US006092309A

United States Patent [19]

Edwards

[11] Patent Number: 6,092,309

[45] Date of Patent: Jul. 25, 2000

[54] HEEL AND SOLE STRUCTURE WITH INWARDLY PROJECTING BULGES

[75] Inventor: Harry W. Edwards, Barrington, Ill.

[73] Assignee: Energaire Corporation, Cheyenne, Wyo.

[21] Appl. No.: 09/273,963

[22] Filed: Mar. 22, 1999

[51] Int. Cl.[7] ..... A43B 13/20

[52] U.S. Cl. ..... 36/29; 36/28; 36/35 B

[58] Field of Search ..... 36/28, 29, 30 R, 36/3 B, 35 B, 37

[56] References Cited

U.S. PATENT DOCUMENTS

| | | | |
|---|---|---|---|
| 508,034 | 11/1893 | Moore . | |
| 547,645 | 10/1895 | LaCroix . | |
| 766,101 | 7/1904 | Croner | 36/28 |
| 850,327 | 4/1907 | Tauber . | |
| 1,605,985 | 11/1926 | Rasmussen . | |
| 1,676,162 | 7/1928 | Schiller . | |
| 2,080,499 | 5/1937 | Nathansohn . | |
| 2,600,957 | 6/1952 | Bartis . | |
| 3,225,463 | 12/1965 | Burnham | 36/29 |
| 4,237,625 | 12/1980 | Cole et al. . | |
| 4,358,902 | 11/1982 | Cole et al. . | |
| 4,397,104 | 8/1983 | Doak . | |
| 4,417,407 | 11/1983 | Fukuoka . | |
| 4,446,634 | 5/1984 | Johnson et al. . | |
| 4,458,430 | 7/1984 | Peterson . | |
| 4,577,417 | 3/1986 | Cole | 36/29 |
| 4,676,009 | 6/1987 | Davis et al. . | |
| 4,744,157 | 5/1988 | Dubner . | |
| 4,918,838 | 4/1990 | Chang | 36/29 |
| 5,325,614 | 7/1994 | Rosen . | |
| 5,375,346 | 12/1994 | Cole et al. . | |
| 5,545,463 | 8/1996 | Schmidt et al. . | |
| 5,678,328 | 10/1997 | Schmidt et al. . | |
| 5,679,439 | 10/1997 | Schmidt et al. . | |
| 5,701,687 | 12/1997 | Schmidt et al. . | |
| 5,794,359 | 8/1998 | Jenkins et al. . | |
| 5,842,291 | 12/1998 | Schmidt et al. | 36/29 |
| 5,896,681 | 4/1999 | Lin | 36/29 |
| 5,896,682 | 4/1999 | Lin | 36/29 |

FOREIGN PATENT DOCUMENTS

| | | |
|---|---|---|
| 721492 | 7/1931 | France . |
| 1287477 | 1/1969 | Germany . |
| 1337 | 2/1912 | United Kingdom . |
| 338266 | 11/1930 | United Kingdom . |
| 2114425 | 2/1982 | United Kingdom . |

*Primary Examiner*—M. D. Patterson
*Attorney, Agent, or Firm*—Emrich & Dithmar

[57] ABSTRACT

A sole and heel structure is provided. The structure includes an outsole having interior and ground contacting surfaces, a pocket-forming midsole overlying the outsole having an outsole-facing surface and an interior surface, first and second bulges projecting from the interior surface of the midsole away from the ground contacting surface and defining first and second cavities opening at the outsole-facing surface. The first and second bulges respectively cooperate with substantially flat portions of the outsole to respectively define first and second pockets. The structure also includes a cushioning midsole having first and second holes and an outsole-facing surface and a foot-facing surface. The first and second bulges respectively project into the first and second holes. The structure further includes means for hermetically attaching the interior surface of the outsole to the outsole-facing surface of the pocket-forming midsole to form a member, a passageway in the member providing fluid communication between the first and second members, and fluid disposed in the space jointly defined by the first and second pockets and the passageway. A shoe incorporating this structure is also provided.

15 Claims, 5 Drawing Sheets

HEEL AND SOLE STRUCTURE WITH INWARDLY PROJECTING BULGES

BACKGROUND OF THE INVENTION

1. Field of the Invention

The present invention relates to shoe sole and heel constructions and, in particular, to such constructions with fluid-filled cavities for providing cushioning and forward thrust.

2. Description of the Prior Art

Various types of shoe sole and heel constructions having fluid-containing cavities have heretofore been provided, such constructions being disclosed, for example, in U.S. Pat. Nos. 4,237,625, 4,358,902, 4,577,417, 5,375,346, 5,416,986 and 5,678,328.

These patents disclose molded outer sole and heel members, each having plural pockets, at least one of the pockets being defined, at least in part, by a downwardly projecting heel or metatarsal bulge molded in the member, and a passageway extending between the pockets. Air or other fluid, at atmospheric pressure, moves back and forth between the pockets through the passageway during movement of a person wearing the shoe.

These prior sole and heel structures have provided cushioning for the user's foot and have also provided forward thrust which facilitates walking or running movements. These downwardly projecting bulges usually, however, prevent the member from having an exterior flat portion in both the heel and sole portions of the outsole, which limits the versatility of the shoe. Additionally, these bulges can tend to produce a lateral instability in the shoe, causing the shoe to tilt laterally inwardly or outwardly in use, resulting in pronation of the wearer's feet. For example, in walking and jogging gaits, wherein the initial shoe strike is at the heel, the initial point of impact is typically at the laterally outer side of the heel, i.e., at the right side of the right heel and the left side of the left heel. Thus, there is a tendency for the fluid in the heel pocket to move from side to side, as well as forwardly toward the metatarsal pocket. Though this instability has been alleviated by providing downwardly projecting stabilizing structures adjacent to the bulges or by reconfiguring the fluid flow and bulge configurations, shoes incorporating these prior structures do not provide a flat sole or heel and, therefore, cannot be used for all applications.

Further, these exterior bulges are exposed and unprotected, and may possibly, if put in a harsh environment, such as a shop floor, be punctured by a nail or the like. The puncture hole would allow the air contained in the cavity to escape, thereby essentially destroying fluid flow between the pockets and the cushioning of the pockets.

Other shoe sole and heel structures include internal, interconnected air pockets in the midsole of a shoe. These structures suffer from, among other things, poor fluid flow from one pocket to another, thereby decreasing the cushioning efficiency of each pocket.

SUMMARY OF THE INVENTION

It is a general object of the invention to provide an improved shoe sole and heel structure which avoids the disadvantages of prior structures while affording additional structural and operational advantages.

An important feature of the invention is the provision of a shoe sole and heel structure which is of relatively simple and economical construction.

A still further feature of the invention of a shoe sole and heel structure which has substantially flat external sole and heel portions which provide improved lateral stability and versatility.

Yet another important feature of the invention is the provision of a shoe sole and heel structure of the type which includes fluid-filled pockets and communicating passageways therebetween, which optimize the cushioning effect of the fluid.

Certain of these and other features of the invention may be attained by providing a shoe sole and heel structure including an outsole having interior and ground contacting surfaces and a pocket-forming midsole overlying the outsole having an outsole-facing surface and an interior surface. The pocket-forming midsole including first and second bulges projecting from the interior surface away from the ground contacting surface and defining first and second cavities opening at the outsole-facing surface. The first and second bulges respectively cooperate with substantially flat portions of the outsole to respectively define first and second pockets. The sole and heel structure also includes a cushioning midsole having first and second holes and an outsole-facing surface and a foot-facing surface. The first and second bulges respectively project into the first and second holes. The structure further includes means for hermetically attaching the interior surface of the outsole to the outsole-facing surface of the pocket-forming midsole to form a member, a passageway in the member providing fluid communication between the first and second pockets, and fluid disposed in the space jointly defined by the first and second pockets and the passageway.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
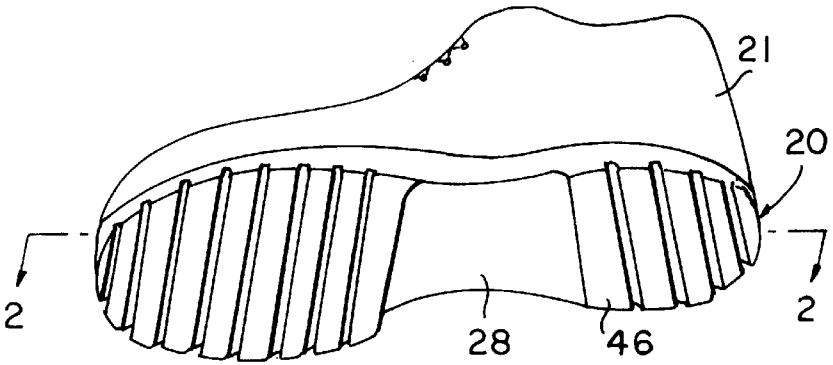
FIG. 1 is a bottom perspective view of a shoe incorporating the sole and heel structure of the present invention.
Figure 2:
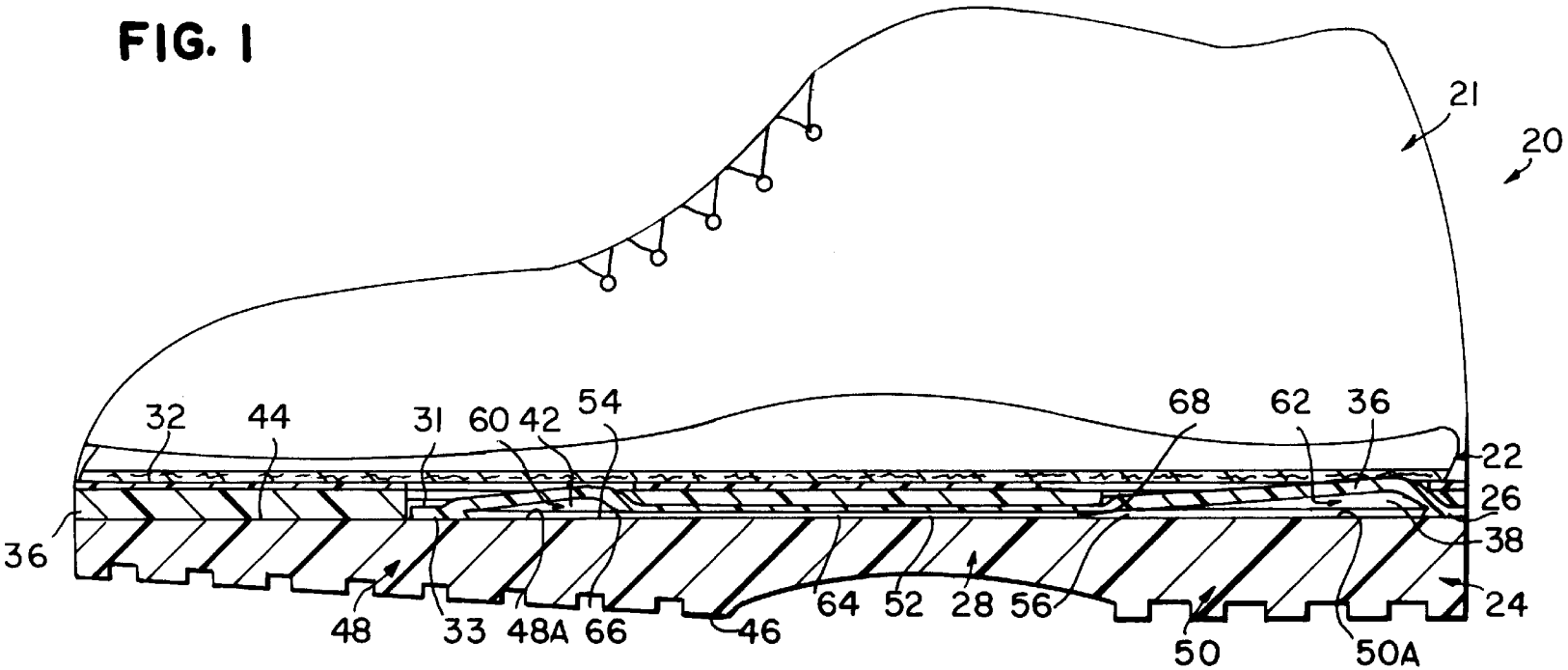
FIG. 2 is a side elevation view of the shoe of FIG. 1, partially in section, taken generally along line 2—2 of FIG. 1.

Referring to FIGS. 1 and 2, there is illustrated a shoe 20, such as a work boot, having a conventional foot-receiving upper portion 21 including a insole 22. The shoe 20 also includes an elongated, three-piece, outer sole and heel structure 24 connected to the upper portion 21 and which includes a pocket-forming midsole 26 overlying an outsole 28, and a cushioning midsole 30 directly overlying portions of the outsole 28 and pocket-forming midsole 26.

Referring also to FIGS. 3–6, the pocket-forming midsole 26 has a generally planar upwardly (or inwardly) facing surface 31 which faces a wearer's foot or a sock liner 32 (FIG. 2). The pocket-forming midsole 26 also has a downwardly facing surface 33 which faces the outsole 28. As discussed in greater detail below, the pocket-forming midsole 26 may be an elongated molded piece made out of a light-weight, generally non-porous material which prevents the transmission of fluids, such as air, therethrough. Useful midsole materials include molded polyurethane and thermoplastic urethane ("TPU"). The pocket-forming midsole 26, as seen in FIGS. 2 and 4–6, has a sole portion 34 located under the sole of a wearer's foot and a heel portion 36 located under the heel of a wearer's foot. The heel portion 36 of the pocket-forming midsole 26 includes a heel bulge 37 projecting up (or inwardly) from the plane of the upwardly facing surface 31 and defining a heel cavity 38. The sole portion 34 includes a metatarsal bulge 40 projecting up (or inwardly) from the plane of the upwardly facing surface 31 and defining a metatarsal cavity 42. Each of the cavities 38 and 42 opens downwardly at the downwardly facing surface 33. The bulges 37, 40 may be formed during the molding of the pocket-forming midsole 26.

Figure 3:
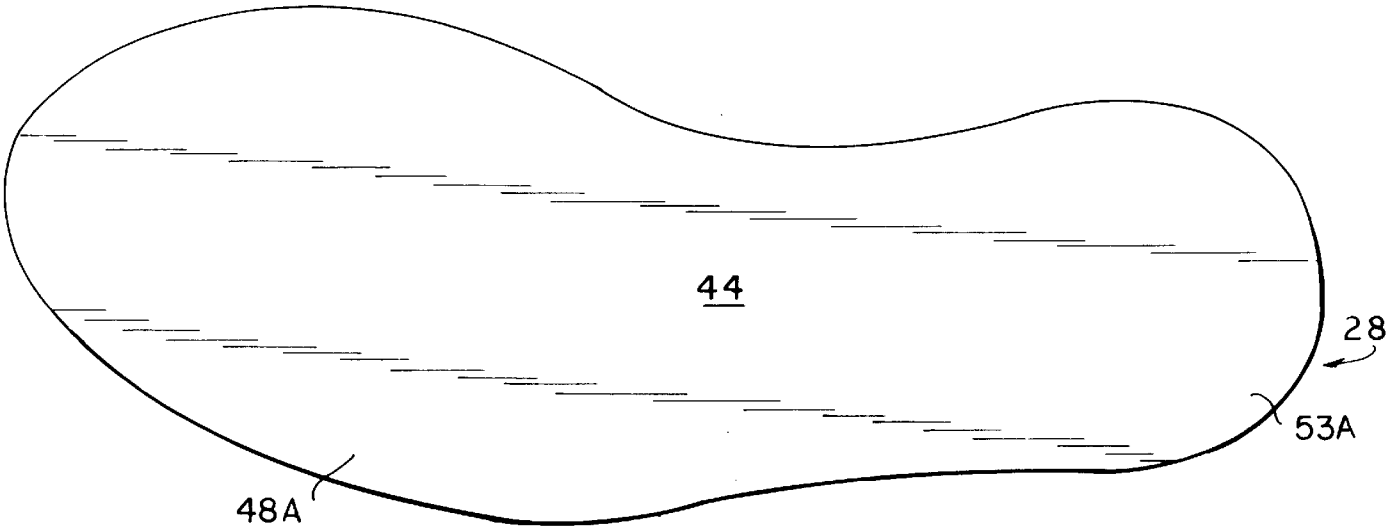
FIG. 3 is a top plan view of the outsole of the sole and heel structure of FIG. 1.

As seen in FIGS. 2 and 3, the outsole 28 is an elongated, preferably one-piece molded construction, preferably made of a highly flexible, highly wear-resistant, oil-resistant material, such as rubber. A very useful rubber is a rubber sold under the brand name "INDY 500" and made by Goodyear Tire and Rubber Company. The outsole 28 has a length greater than that of the pocket-forming midsole 26.

The outsole 28 has an interior surface 44 which faces the midsole 26 and an exterior surface 46 which is subject to constant engagement with the pavement or other underlying support surface, which will hereinafter be referred to as the "ground". The outsole 28 also has a sole portion 48 with a substantially flat portion 48A located under the sole portion 34 of the pocket-forming midsole 26 and the sole of a wearer's foot, and a heel portion 50 with a substantially flat portion 50A located under the heel portion 36 of the pocket-forming midsole 26 and the heel of the wearer's foot.

Figure 4:
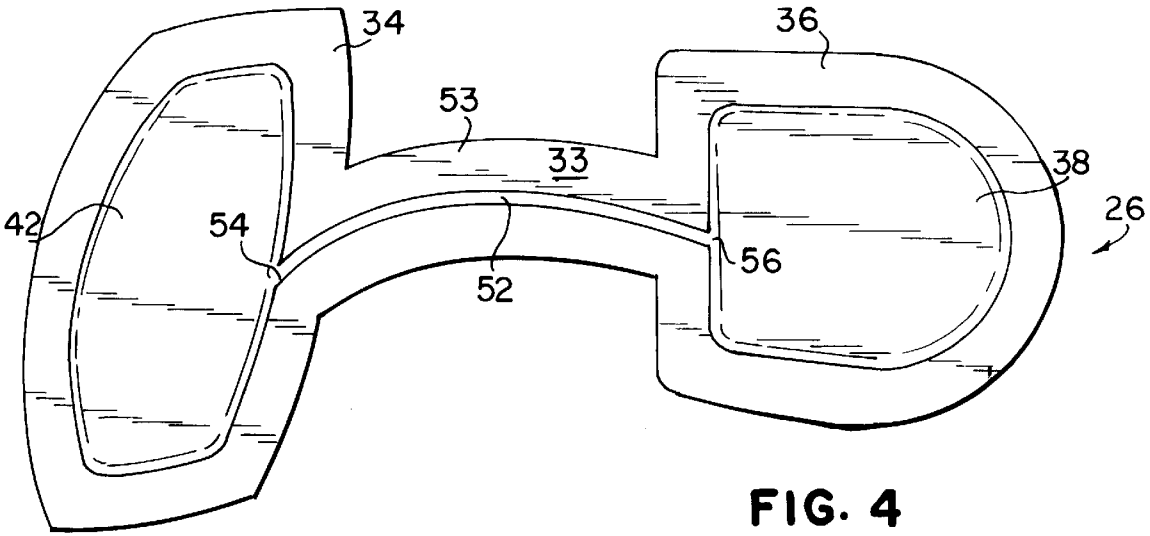
FIG. 4 is a bottom plan view of the pocket-forming midsole of the sole and heel structure of FIG. 1.
Figure 5:
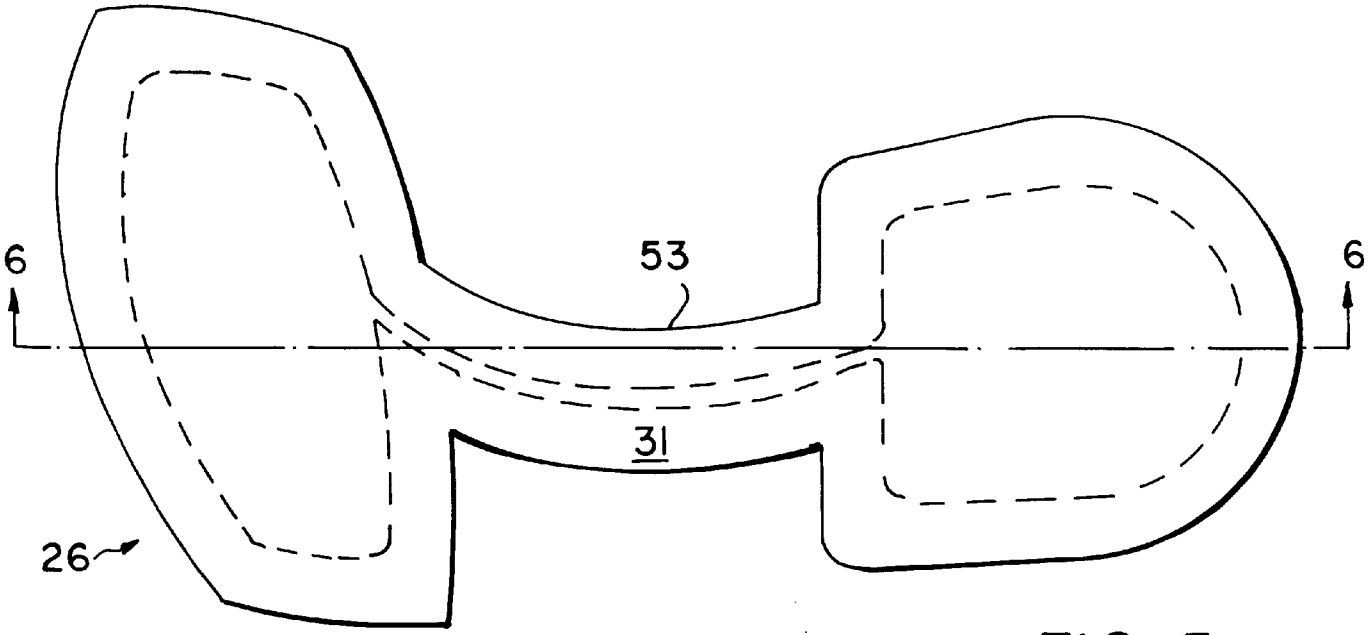
FIG. 5 is a top plan view of the pocket-forming midsole of FIG. 4.
Figure 6:
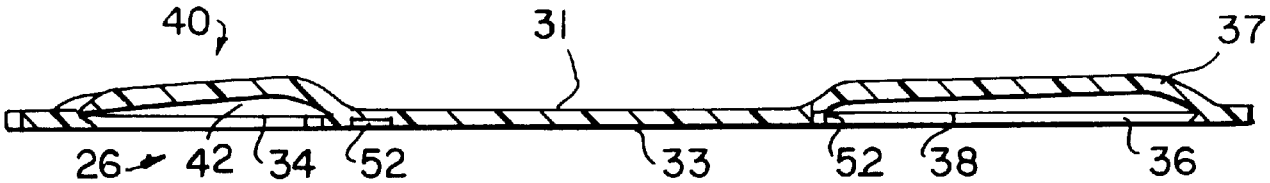
FIG. 6 is a sectional view taken generally along line 6—6 of FIG. 5.

An arcuate-shaped channel cavity 52 is molded into, or otherwise formed, in an arcuate-shaped narrower central portion 53 of the pocket-forming midsole 26 and opens downwardly at the downwardly facing surface 33. As seen in FIG. 4, the channel cavity 52 extends from a first end 54, which communicates with the metatarsal cavity 42, to a second end 56, which communicates with heel cavity 38.

Referring to FIG. 2, an adhesive is disposed between the interior surface 44 of the outsole 28 and the downwardly-facing surface 33 of the pocket-forming midsole 26 for fixedly securing the two together in a fluid-tight manner. In this regard, as discussed above, it will be appreciated that the pocket-forming midsole 26 and the outsole 28 are formed of fluid-impermeable materials and are also resilient to accommodate flexing during use of the shoe 20. Thus, the pocket-forming midsole 26 and the outsole 28 cooperate to hermetically seal and form metatarsal and heel pockets 60 and 62 and a restricted passageway 64 therebetween, permanently trapping air or other fluid, preferably at atmospheric pressure, therein.

Metatarsal pocket 60 is defined by the metatarsal cavity 42 and the flat sole portion 48A of the outsole 28 underlying the metatarsal cavity 42. Restricted passageway 64 is defined by channel cavity 52 and the portion of the outsole 28 underlying the channel cavity 52. Heel pocket 62 is defined by the heel cavity 38 and the flat heel portion 50A of the outsole 28 underlying the heel cavity 38.

As best seen in FIG. 2, restricted passageway 64 has a first opening 66 at the first end 54 of the channel cavity 52, which opens into the metatarsal pocket 60, and a second opening 68 at the second end 56 of the channel cavity 52 which opens into the heel pocket 62. The restricted passageway 64 thereby allows the metatarsal pocket 60 to fluidly communicate with the heel pocket 62.

In use, the air in pockets 60, 62 provides a cushioning effect. In walking and running, the heel portion 50 of the outsole 28 first comes in contact with the ground and the heel of a wearer's foot exerts pressure on the pocket-forming midsole 26 above the heel pocket 62. The force of the ground contacting the heel portion 50 of the outsole 28 and the force of the wearer's heel on the pocket-forming midsole 26 causes the air to be compressed in the heel pocket 62 and forced through the passageway 64 into the metatarsal pocket 60. As the heel portion lifts off the ground and the sole portion 48 of the outsole 28 contacts the ground, a wearer's foot exerts pressure on the pocket-forming midsole 26 above the metatarsal pocket 60. The force of the ground contacting the sole portion 48 of the outsole 28 and the force of the metatarsal area of the wearer's foot on the pocket-forming midsole 26 causes the air to be compressed in the metatarsal pocket 60 and forced through passageway 64 back into heel pocket 62 to give a lifting effect. Thus, during striding, such as walking and running, the air moves back and forth between the pockets 60 and 62 through the passageway 64 to give an alternating lifting effect and provide thrust both at the metatarsal ball area and in the heel area that facilitates walking and running.

The volume of the metatarsal pocket 60 may be, though is not necessarily, generally equal to the volume of the heel pocket 62.

Figure 7:
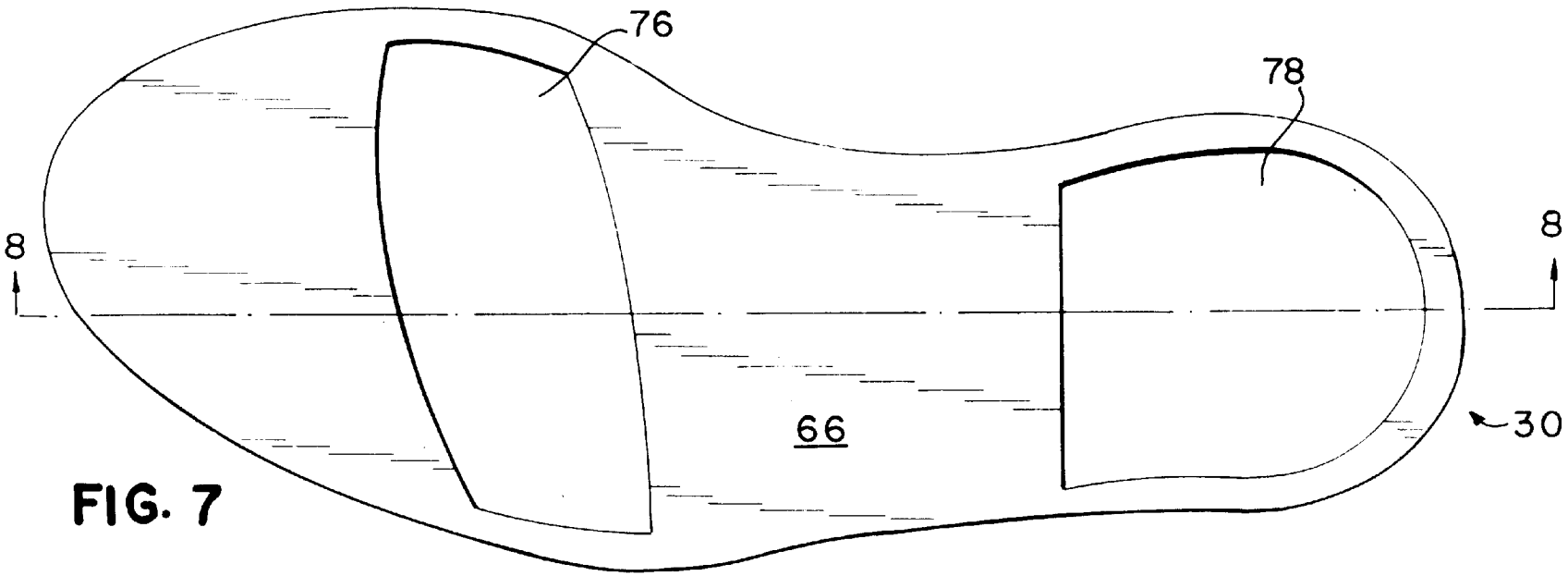
FIG. 7 is a top plan view of the cushioning midsole of the heel and sole structure of FIG. 1.
Figure 8:
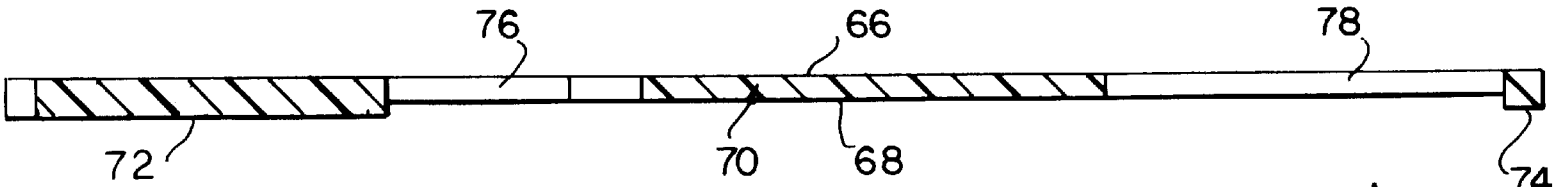
FIG. 8 is a sectional view taken generally along the line 8—8 of FIG. 7.

Referring also to FIGS. 7 and 8, the cushioning midsole 30 is formed of a material which provides cushioning to a user's foot, such as EVA. The cushioning midsole 30 has an upper foot-facing surface 66 and a downwardly facing surface 68. The foot-facing surface 66 is attached to the combined pocket-forming midsole 26 and outsole 28 by adhesive, or the like. The cushioning midsole 30 also includes a central portion 70 and two opposite thicker, longitudinal end portions 72, 74. The cushioning midsole 30 includes a metatarsal hole 76 and a heel hole 78 respectively shaped to receive the metatarsal bulge 40 and heel bulge 37 which, respectively, project upwardly (or inwardly away from the exterior surface 46 of the outsole 28) into the metatarsal hole 76 and the heel hole 78 of the cushioning midsole 30, such that the majority, if not all, of the upper surfaces of the bulges 37, 40 lie below the foot-facing surface 66 of the cushioning midsole 30.

Figure 9:
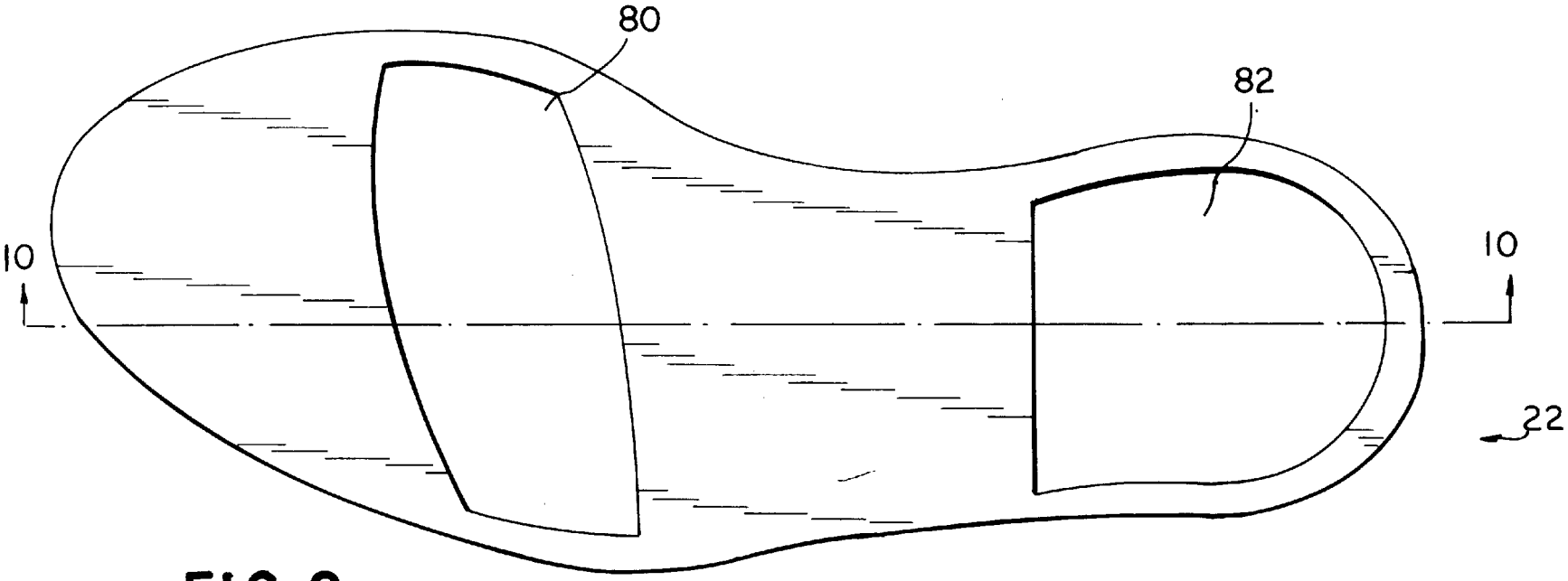
FIG. 9 is a top plan view of the last of the shoe of FIG. 1.
Figure 10:
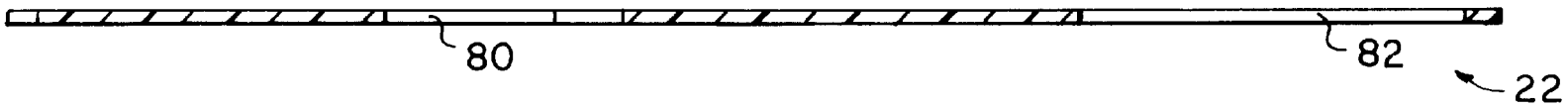
FIG. 10 is a sectional view taken generally along the line 10—10 of FIG. 9.

Referring to FIGS. 9 and 10, the insole 22 of the shoe 20 also includes a metatarsal aperture 80 and heel aperture 82, respectively located above metatarsal hole 76 and heel hole 78 of the cushioning midsole 30 and preferably having the same shapes and peripheral size as the metatarsal hole 76 and heel hole 78, respectively, of the cushioning midsole 30.

The heel and midsole holes 76, 78 of the cushioning midsole 30 and the apertures 80, 82 of the last 22, provide the wearer's foot with direct access to pockets 60, 62 to apply the necessary force to the pockets 60, 62 to properly pass the air therebetween. Additionally, since the bulges 37, 40 are disposed in the holes 76, 78, the cushioning midsole 30 surrounds the bulges 37, 40. As discussed above, together with the foot-facing surface 66 of the cushioning midsole 30, the majority upper surfaces of the bulges 37, 40 lie below the foot-facing surface 66 which reduces the feel of the bulges 37, 40 and aids in replicating the flat feel of a conventional shoe sole and heel structure.

In this regard, since the pocket-forming midsole 26 has a thickness, but does not run the entire length of the outer sole and heel structure 24, the central portion 70 of the cushioning midsole 30, which overlies the entire pocket-forming midsole 26, is thinner than the end portions 72, 74, which either only overlie a small portion of the pocket-forming midsole 26 or only overlie the outsole 28. This prevents the central portion of the outer sole and heel structure 24, which includes the cushioning midsole 30, from being much, if any, thicker than the remainder of the outer sole and heel structure 24 and provides a generally flat upper surface formed by the upper surfaces of the bulges 37, 40 and the foot-facing surface 66 of the cushioning midsole 30.

Alternatively, the holes 76, 78 could be replaced by cavities closed by a thin wall at the foot-facing surface 66 of the cushioning midsole 30 and shaped to receive the bulges 37, 40, whereby the foot-facing surface 66 of the cushioning midsole 30 would be continuous and generally flat. The walls covering the cavities must, however, be thin enough not to interfere with application of force by a wearer's foot.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A sole and heel structure comprising:

an outsole having interior and ground contacting surfaces;

a pocket-forming midsole overlying the outsole having an outsole-facing surface and an interior surface, first and second bulges projecting from the interior surface of the midsole away from the ground contacting surface and defining first and second cavities opening at the outsole-facing surface, the first and second bulges respectively cooperating with substantially flat portions of the outsole to respectively define first and second pockets;

a cushioning midsole having first and second holes and an outsole-facing surface and a foot-facing surface, the first and second bulges respectively projecting into the first and second holes;

means for hermetically attaching the interior surface of the outsole to the outsole-facing surface of the pocket-forming midsole to form a member;

a passageway in the member providing fluid communication between the first and second pockets; and fluid disposed in the space jointly defined by the first and second pockets and the passageway.

2. The structure of claim 1, wherein the member has sole and heel portions, and wherein the first pocket is disposed in the sole portion and underlies the metatarsal ball area of a foot for which the structure is sized and wherein the second pocket is disposed in the heel portion and underlies the heel area of the foot.

3. The structure of claim 2, wherein the passageway includes a channel cavity disposed in one of the outsole and the pocket-forming midsole.

4. The structure of claim 2, wherein the passageway is defined by a channel cavity disposed in the pocket-forming midsole and opening at the outsole-facing surface thereof and a substantially flat portion of the outsole.

5. The structure of claim 1, wherein each of the first and second holes opens at the foot-facing and outsole-facing surfaces of the cushioning midsole.

6. The structure of claim 5, wherein the first and second bulges have upper surfaces, wherein the majority of each of the upper surfaces lie below the foot-facing surface adjacent the first and second holes.

7. The structure of claim 6, wherein the cushioning midsole has a central portion having a thickness, and first and second longitudinal end portions having a thickness greater than first and second pockets and the passageway.

8. A shoe comprising:

a foot receiving upper; and a sole and heel structure connected to the upper, the structure comprising, an outsole having interior and ground contacting surfaces, a pocket-forming midsole overlying the outsole and having an outsole-facing surface and an interior surface, first and second bulges projecting from the interior surface of the midsole away from the ground contacting surface and defining first and second cavities opening at the outsole-facing surface, the first and second bulges respectively cooperating with substantially flat portions of the outsole to respectively define first and second pockets, a cushioning midsole having first and second holes and an outsole-facing surface and a foot-facing surface, the first and second bulges respectively projecting into the first and second holes;

means for hermetically attaching the interior surface of the outsole to the outsole-facing surface of the pocket-forming midsole to form a member, a passageway in the member providing fluid communication between the first and second pockets, and fluid disposed in the space jointly defined by the first and second pockets and the passageway.

9. The shoe of claim 8, wherein the member has sole and heel portions and wherein the first pocket is disposed in the sole portion and underlies the metatarsal ball area of a foot for which the shoe is sized and wherein the second pocket is disposed in the heel portion and underlies the heel area of the foot.

10. The sole of claim 9, wherein the passageway includes a channel cavity disposed in one of the outsole and pocket-forming midsole.

11. The shoe of claim 9, wherein the passageway is defined by a channel cavity disposed in the pocket-forming midsole and opening at the outsole-facing surface thereof and a substantially flat portion of the outsole.

12. The shoe of claim 9, wherein the first and second pockets respectively have first and second volumes, and the first volume is generally equal to the second volume.

13. The shoe of claim 8, wherein each of the first and second holes opens at the foot-facing and outsole-facing surfaces of the cushioning midsole.

14. The shoe of claim 13, wherein the cushioning midsole has a central portion having a thickness, and first and second longitudinal end portions having a thickness greater than that of the central portions.

15. The shoe of claim 8, wherein the upper includes an insole having first and second apertures respectively disposed above the first and second holes.

* * * * *